United States Patent [19]

MacLennan

[11] Patent Number: 4,659,143

[45] Date of Patent: Apr. 21, 1987

[54] FOOD CATCHER FOR ATTACHING TO TABLE

[76] Inventor: Diane MacLennan, 8833 Shoshone Ave., Northridge, Calf. 91325

[21] Appl. No.: 822,736

[22] Filed: Jan. 27, 1986

[51] Int. Cl.[4] ..... A47D 15/00

[52] U.S. Cl. ..... 297/182; 297/174

[58] Field of Search ..... 297/174, 134, 182; 15/257.1; 108/24, 73, 50, 161

[56] References Cited

U.S. PATENT DOCUMENTS

| | | | |
|---|---|---|---|
| D. 152,383 | 1/1949 | Waaranan | 297/134 X |
| 1,437,782 | 12/1922 | Smith | 297/174 |
| 2,359,599 | 10/1944 | Allen | 297/182 |
| 2,540,685 | 2/1951 | Mayer | 297/182 |
| 2,700,413 | 1/1955 | Williams | 297/182 |
| 2,714,417 | 8/1955 | Golding | 297/174 X |
| 2,728,374 | 12/1955 | Whalen | 297/134 |
| 3,059,965 | 10/1962 | Fornetti . | |
| 3,243,229 | 3/1966 | Barnhill | 297/134 |
| 3,298,736 | 5/1967 | Decker | 297/182 |
| 4,058,956 | 11/1977 | Skonieczny | 15/257.1 |
| 4,094,547 | 6/1978 | Zampino et al. | 297/182 |
| 4,298,228 | 11/1981 | Zampino et al. | 297/182 |

*Primary Examiner*—James T. McCall

*Attorney, Agent, or Firm*—Koppel & Harris

[57] ABSTRACT

To catch food and other debris from a child sitting in a seat where the seat is the type that attaches to the edge of the table, the present invention has a pair of arms moveable with respect to each other. The arms are attached to the table to the sides of the seat. Each arm has rearward extensions to which a catcher of flexible cloth or other material is attached. The arms also attach to the table. The flexible catcher then hangs under the child and the seat to catch food and debris. The catcher may have forward portions extending under the table, which also can be attached to the arms under the table.

7 Claims, 3 Drawing Figures

FOOD CATCHER FOR ATTACHING TO TABLE

BACKGROUND OF THE INVENTION

1. Field of the Invention

The present invention relates to a device for attaching to the edge of a table for catching food and other debris, which a child in a seat that is also attached to the table may drop or throw.

2. The Prior Art

Infants and young children spill, drop or throw food, utensils, dishes and just about anything else put in front of them. As those activities cannot be stopped, the problem facing parents is to minimize the damage caused by that activity. One method concentrates on the chair or a tray attached to the chair. Another approach is to guard the floor. It is common to place a sheet of plastic or fabric on the floor under the child.

There have been proposed attachments to child seats for catching the food and other debris. Decker, U.S. Pat. No. 3,298,736 (1967) is an attachment to the legs of a high chair. It is cumbersome to carry a high chair when taking a young child to a restaurant or someone's home. Small portable seats, which attach directly to the edge of a table, have come into favor. They are especially useful in restaurants because they are compact and allow food for the infant to be placed directly on the table. Fornetti, U.S. Pat. No. 3,059,965 (1962) and Barnhill, U.S. Pat. No. 3,243,229 (1966) are examples of such seats. The later patent describes a carrier in which the infant normally lies rather than sits. There are currently several similar carriers marketed today.

An object of the present invention is to disclose and provide a device for use with such an infant or child chair for catching debris and other objects that the child might throw or drop. A further object is to make the device easily transportable by having it light weight and collapsible. Another object is to make the device adjustable so that the material that catches the food or other debris can be positioned off the floor but out of contact with the child's feet. A further object is to have the device extend forward of the infant to catch food or other debris that the infant or baby may throw forward. Extending the device forward also tends to catch spills.

SUMMARY OF THE INVENTION

The device of the present invention meets these objects by having a pair of arms independent from each other. Each arm has (a) attaching means for attaching each of the arms to a table on both sides of the child seat and (b) an extension away from the edge of the table. The catching means is made of flexible material and extends between the two arms. The attaching means are similar in function to the attaching means of the child seat in that it has a bottom.portion that contacts the bottom of the table and a top portion that contacts the top of the table closer to the edge of the table than the point of the bottom portion contacts the bottom of the table. The front end of the material is attached to the bottom portion of the attaching means to create a forward lip under the table in front of the infant to catch food and other debris that may fall in that direction. By positioning the arms closer or farther apart from the child seat, the material under the infant is pulled slightly aparat to raise it or allow it to hang more.

DETAILED DESCRIPTION OF THE PREFERRED EMBODIMENT

Figure 1:
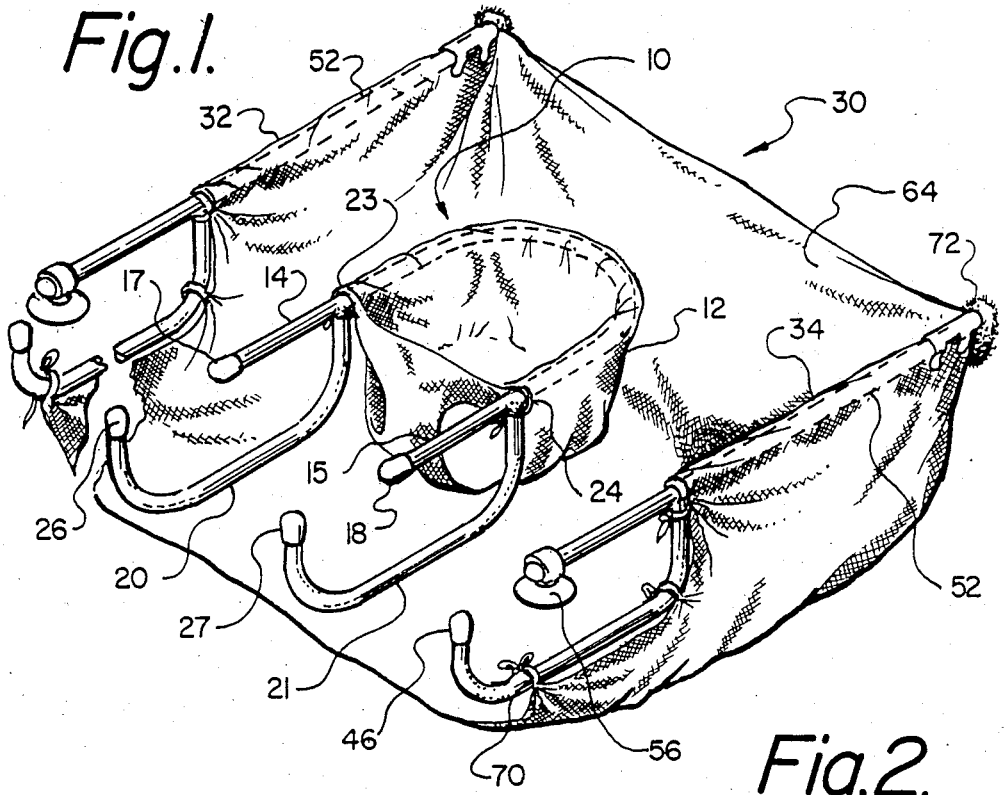
FIG. 1 is a perspective view of the device of the present invention for catching food and other debris, which is shown with an infant seat of the type that attaches to the edge of a table.

The device of the present invention for catching food and other debris from a child in a seat is primarily for use with seats of the type shown in FIG. 1. The seat itself is not part of the present invention. Seat 10 (FIG. 1) has a U-shaped upper support member from which a flexible seating portion 12 hangs. Other such seats have rigid seat member. The support member is shown to curve behind the infant's back in FIG. 1, but the shape can be changed. The support member has two forward extensions 14 and 15, which are in the same plane as the support member and extend along the top of a table. Rubber feet 17 and 18 are on the ends of forward extensions 14 and 15 for preventing the seat from scratching the table and to provide friction to anchor the seat to the table. A depending bottom support 20, 21 extends from each of the forward extensions 14, 15 under the table. One end of each bottom support is welded or otherwise attached to forward extensions 14 and 15 at welds 23, 24. The other end of the bottom support has rubber feet 26, 27, which contact the bottom of the table. With the geometry of seat 10 shown in FIG. 1, feet 17 and 18 on the top of the table are closer to the edge of the table (not shown) than feet 26 and 27 on the bottom support so that weight on the seat portion 12 pivots the seat about feet 17 and 18 and pushes feet 26 and 27 harder into the bottom of the table to lock the seat to the table. The seat is constructed such that the position of all of the parts is fixed relative to each other because of the rigid support member.

The device of the present invention catches food or other debris from a child sitting in a seat such as seat 10. The device 30 of the exemplary embodiment has two arms 32 and 34. The arms of the exemplary embodiment are formed of tubular steel, but aluminum, wood, plastic or other suitable materials may be substituted. The arms may also have a different cross-section and a different diameter.

Each arm has attaching means for attaching each arm to the table. In the exemplary embodiment, the attaching means are quite similar to the attaching systems of the associated seat 10. That is, the attaching means has a bottom portion 36 (FIGS. 1 and 2) which extends partially under table 2 from edge 3 (FIG. 2) to contact the underside 4 of the table. In the exemplary embodiment, bottom portion 36 is welded to arm 34 at connection 38. It has a downward leg 40 that curves into portion 42, which is inclined slightly (FIG. 2), and that portion curves into an upward leg 44. A rubber cap 46 is on the end of upward leg 44, and the cap contacts the underside of the table. The cap adds friction and protects the table.

Figure 2:
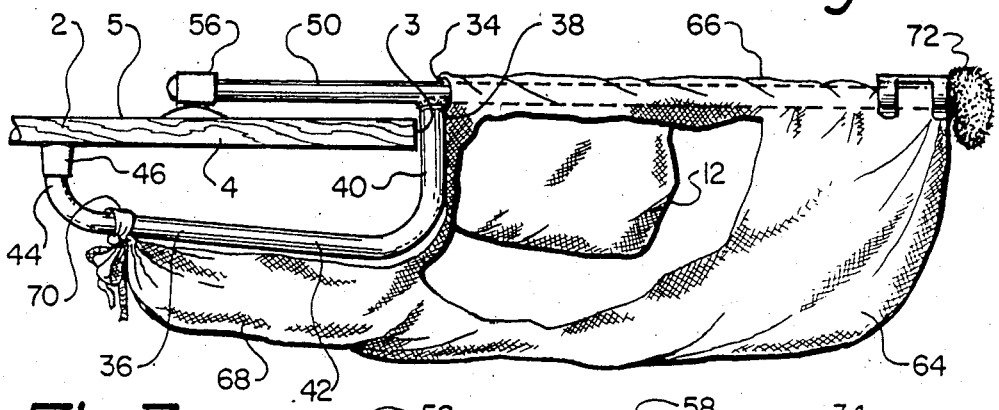
FIG. 2 is a side view, partially cut away of the device of the present invention.
Figure 3:
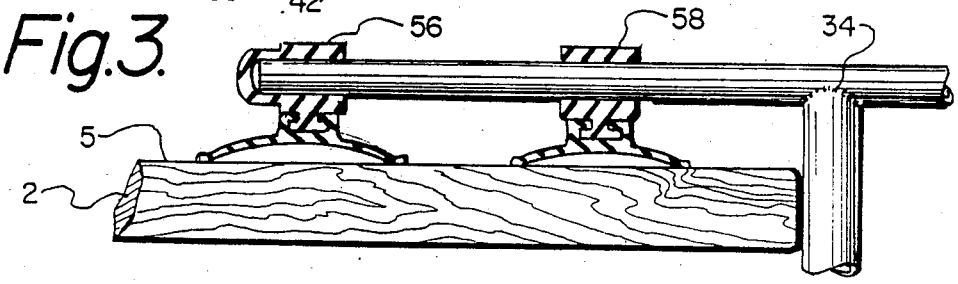
FIG. 3 is a side view showing the detail of the upper portion of the attaching means of the present invention.

The attaching means also has an upper portion that extends along top 5 of table 2. In the exemplary embodiment, top portion 50 is a forward extension of arm 32 or 34, and it is aligned with rear extension 52 of each arm, which extends away from edge 3 of table 2. In the exemplary embodiment, top portion 50 is flat, and it has a front suction cup 56 (FIGS. 2 and 3). There may also be a rear suction cup 58. The suction cup(s) secures forward portion 50 to the top 5 of table 2.

Catching means extends between the arms for hanging under the seat. In the exemplary embodiment, catching means 64 is formed of flexible material such as cloth or plastic. The sides of catcher 64 are cut to the shape shown in FIGS. 1 and 2. There is a cut-out region to conform to the shape of bottom portion 36. The rest of each side of catcher 64 is looped over itself to create casing 66 (FIG. 3) into which rear extensions 52 of arms 32 and 34 slide. Rear extensions 52 may have a protective pad 72 to protect children or others who might bump into the end of the either arm extension 32 or 34.

As an alternative, a connecting bar (not shown) could attached the rear ends of arm extensions 32 and 34 together. A connecting bar would prevent one (especially a small child) from bumping into the end of the arm if he were between the two arm. The bar would also help maintain the distance between the two arms at their rear ends. Pad 72 could be used in conjunction with the connecting bar. The connecting bar could be permanently attached for pivoting with respect to the ends of arm extensions 32 and 34. A pivot allows the arm to fold together for storage. The connecting bar could also snap onto or otherwise temporarily attach to the end of the arm extension.

Catch 64 also has a front portion 68 that extends under table 2 in front of the child sitting in seat 10. Each side of front portion 68 of catcher 64 is removeably attachable to bottom portion 36 of arm members 32 and 34. In the exemplary embodiment, the front portion is attached by means of a short strap 70, which loops over inclined portion 42 and can be tied to itself or otherwise attached with Velcro fasteners or other types of connectors.

The front, rear and sides of catcher 64 create a trough in which to catch debris. The catcher extends approximately to the height of the table, so it will catch almost everything that is dropped or spilled. A child will have to throw debris up to have it miss the catcher. As long as the catcher is made wide enough, arms 32 and 34 can be spaced far enough apart to make it difficult for many children to throw beyond the catcher's boundary.

Note that arms 32 and 34 are independent from each other whereas the members that attach seat 10 to the table are fixed. As a result, it may be desirable to add the second suction cup 58 on each arm to help prevent each arm from pivoting horizontally relative to the table. Making the arms independently from each other adds much flexibility to the device. For example, the edge of the table to which the device is to be attached may be quite narrow so that the attaching means of the device of the present invention may have to be positioned to close to seat 10 to fit on the edge of the table, but arms 32 and 34 can be angled outward away from the table so that there is still a relatively wide expanse near the child.

The device is light weight. There is not a great deal of force applied by the device on the table. It may be easy for arms 32 and 34 to pivot horizontally. The second suction cup 58 (FIG. 3) limits the ability of the arms to pivot.

When the device is not in use, the arms can be brought together for easy transporting or pivoted together if there is a rod attached to the rear of arms 32, 34. The fabric can be wrapped around the arms to hold them together. A fastener (not shown) can also be provided on the underside of catch 64 to hold the catcher wrapped around the arms.

Various modifications and changes may be made in the configuration described above that come within the spirit of this invention. The invention embraces all such changes and modifications coming within the scope of the appended claims.

I claim:

1. A device for catching food and other debris from a child in a seat, wherein the seat is the type that attaches to the edge of a table, the device comprising:

(a) a pair of arms moveable with respect to each other;

(b) attaching means on each arm for attaching each arm to the table spaced apart from the sides of the seat;

(c) extension means on each arm for extending away for the edge of the table; and (d) catching means between the arms means for hanging under the seat.

2. The device for catching food and other debris of claim 1, wherein the catching means is formed of flexible material.

3. The device for catching food and other debris of claim 1, wherein the attaching means has a bottom portion, which extends partially under the table and contacts the underside of the table at a first point, the attaching means further having an upper portion extending over the table and in contact with the top surface of the table at a second point, the second point being closer to the edge of the table than the first point.

4. The device for catching food and other debris of claim 3, the extension means being generally parallel to the upper portion of the attaching means.

5. The device for catching food and other debris of claim 1, the catching means having front means for connecting to the attaching means under the table.

6. The device for catching food and other debris of claim 5, wherein the attaching means has a bottom portion, which extends partially under the table and contacts the underside of the table at a first point, the attaching means further having an upper portion extending over the table and in contact with the top surface of the table at a second point, the front means being connected to the bottom portion under the table.

7. The device for catching food and other debris of claim 1, wherein the catching means is wide enough to be out of contact with the feet of the child in the infant seat when the attaching means is attached to a table of the sides of the infant seat.

* * * * *